United States Patent [19]

Yokoyama

[11] Patent Number: 4,895,510

[45] Date of Patent: Jan. 23, 1990

[54] COMBUSTION CHAMBER OF A PULSATING COMBUSTOR

[75] Inventor: Nobuyoshi Yokoyama, Toyoake, Japan

[73] Assignee: Paloma Kogyo Kabushiki Kaisha, Japan

[21] Appl. No.: 299,396

[22] Filed: Jan. 23, 1989

[30] Foreign Application Priority Data

Aug. 24, 1988 [JP] Japan ..... 63-110881

[51] Int. Cl.[4] ..... F23C 11/04

[52] U.S. Cl. ..... 431/1; 122/24

[58] Field of Search ..... 431/1; 122/24; 60/39.76, 39.77, 247; 432/25

[56] References Cited

U.S. PATENT DOCUMENTS

| | | | |
|---|---|---|---|
| 3,267,986 | 8/1966 | Olsson | 431/1 |
| 3,463,392 | 8/1969 | Schallert | 431/1 |
| 4,574,745 | 3/1986 | Belles | 122/24 |
| 4,708,634 | 11/1987 | Vergre | 431/1 |

FOREIGN PATENT DOCUMENTS

| | | | |
|---|---|---|---|
| 960130 | 7/1949 | Fed. Rep. of Germany | 431/1 |

*Primary Examiner*—Randall L. Green

*Attorney, Agent, or Firm*—Lahive & Cockfield

[57] ABSTRACT

A vessel assembly defining a combustion chamber in a pulsating combustor is composed of a pair of generally boat-shaped vessels each made by plastic deformation and having a longitudinal plane terminating in a transverse plane which is perpendicular to its longitudinal plane. Each vessel is open in both of its longitudinal and transverse planes and has an exhaust port. The vessels are joined to each other in their longitudinal planes to form an integral assembly which is totally closed except for the exhaust ports and the transverse planes in which they form an end opening for admitting a mixture of fuel and air into the assembly. The assembly is joined around its end opening to the edge of an opening made in a wall defining a vessel for holding the liquid to be heated.

4 Claims, 3 Drawing Sheets

COMBUSTION CHAMBER OF A PULSATING COMBUSTOR

BACKGROUND OF THE INVENTION

1. Field of the Invention

This invention relates to a pulsating combustor and more particularly its combustion chamber.

2. Description of the Prior Art

It has hitherto been usual to use a cast vessel to form a combustion chamber in a pulsating combustor, as disclosed, for example, in Japanese Utility Model Publication Nos. 14168/1988 and 14169/1988 and Japanese Utility Model Application Laid Open No. 2118/1985. This is apparently due to the fact that a port through which a mixture of fuel and air enters the chamber and a port through which exhaust gases leave it are easy to form by casting.

The cast vessel defining the combustion chamber is bolted to the wall of a vessel for holding the liquid to be heated and packing is disposed therebetween. When the pulsating combustor is used as a source of heat supply for a fryer, water heater, etc., however, the liquid, such as oil or water, is heated to so high a temperature that the packing is often distorted, or the vessel defining the combustion chamber is otherwise damaged. The loosening of the bolts used for mounting the cast vessel is also likely to occur. These inconveniences are likely to cause the liquid to start leaking out at an unduly early date. Moreover, the cast vessel is heavy and costly.

SUMMARY OF THE INVENTION

Under these circumstances, it is an object of this invention to provide a vessel for defining a combustion chamber in a pulsating combustor which is durable for a long time of reliable use without causing any leakage of the liquid to be heated, and which is, moreover, light in weight and inexpensive to manufacture.

This object is essentially attained by a vessel assembly composed of a pair of generally boat-shaped vessels each made by plastic deformation and having a longitudinal plane terminating in a transverse plane which is perpendicular to the longitudinal plane, each vessel being open in both of its longitudinal and transverse planes and having an exhaust port, the vessels being joined to each other in their longitudinal planes to form an integral assembly which is totally closed except for the exhaust ports and the transverse planes in which the vessels cooperate with each other to form an end opening for admitting a mixture of fuel and air into the assembly, the assembly being joined around its end opening to the edge of an opening made in a wall defining a vessel for holding the liquid to be heated.

The boat-shaped vessels are made by plastic deformation, such as pressing. Therefore, vessels of uniform quality can be made on a mass-production scale. They can be joined to each other easily by welding, brazing or soldering to form a liquid-tight assembly which does not allow any leakage of the liquid to be heated, but remains durable for a long period of time for defining a highly reliable combustion chamber. Each vessel can be formed from a metal plate having a relatively small thickness. The vessel assembly of this invention is, therefore, inexpensive to manufacture and light in weight, as compared with any known cast vessel.

DETAILED DESCRIPTION OF THE INVENTION

Figure 1:
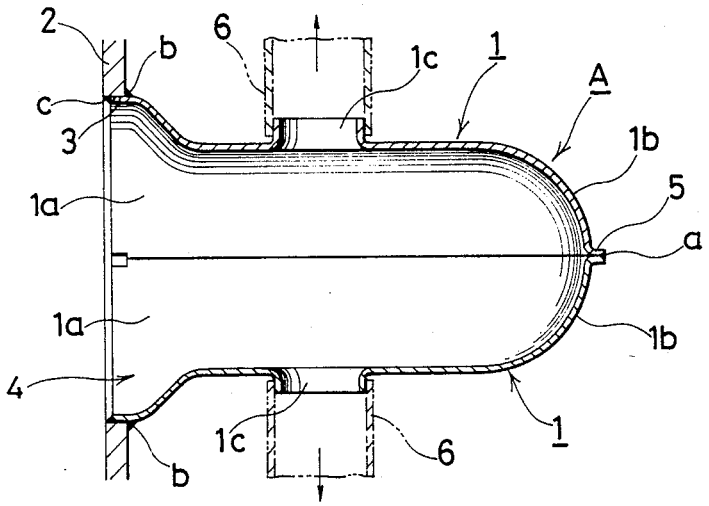
FIG. 1 is a horizontal cross-sectional view of a vessel assembly embodying this invention.
Figure 2:
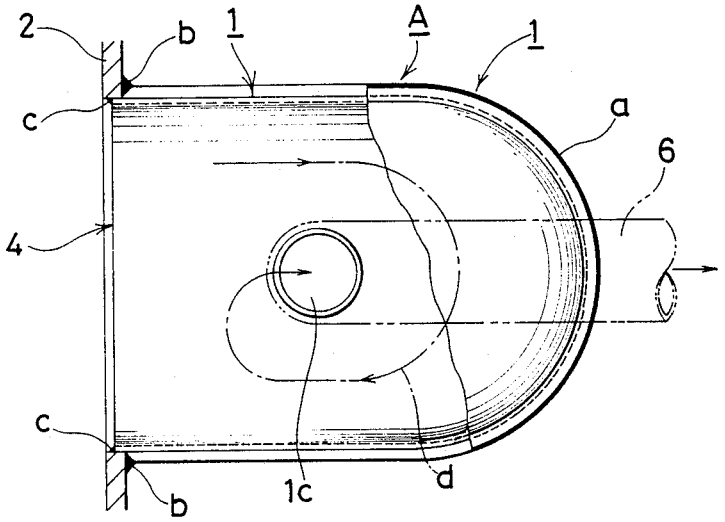
FIG. 2 is a front elevational view, partly in section, of the vessel assembly shown in FIG. 1.
Figure 3:
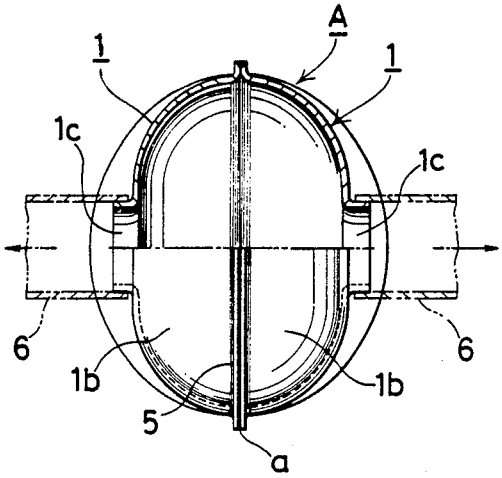
FIG. 3 is a side elevational view, partly in section, of the vessel assembly shown in FIG. 1.
Figure 4:
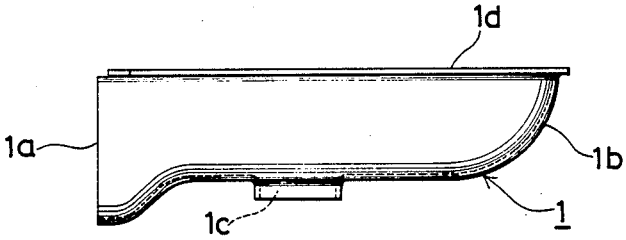
FIG. 4 is a top plan view of one of the two boat-shaped vessels constituting the vessel assembly shown in FIG. 1.
Figure 5:
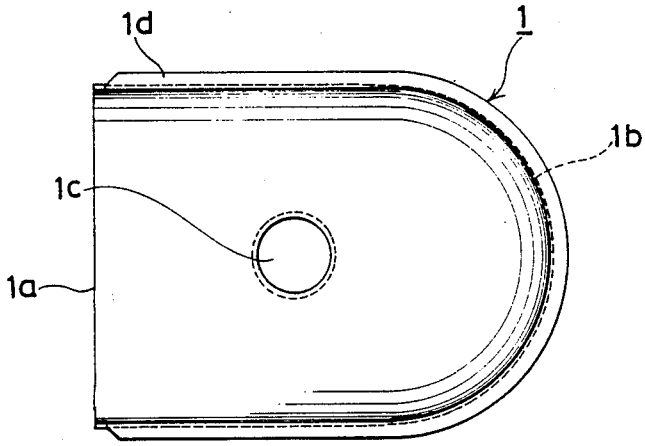
FIG. 5 is a front elevational view of the vessel shown in FIG. 4.

A vessel assembly embodying this invention is shown by way of example in FIGS. 1 to 3. It consists of a pair of generally boat-shaped vessels 1 having the same size and shape and joined to each other. One of the boat-shaped vessels 1 is shown in FIGS. 4 and 5. Each vessel 1 has a substantially semi-oval sidewall terminating at one end thereof in a substantially one-fourth-spheroidal end wall 1*b* and at the other end in a radially enlarged portion defining an open end 1*a*. The vessel 1 has a bottom provided with a short cylindrical projection defining an exhaust port 1*c* substantially in the center of the vessel 1. Each vessel 1 is a product of plastic deformation, such as pressing, prepared from a heat and corrosion resistant metal plate having a relatively small thickness.

Each vessel 1 has a substantially U-shaped edge 1*d* located in a longitudinal plane and surrounding the open top of its sidewall. The edge 1*d* terminates in a substantially semi-oval edge lying around the open end 1*a* and in a transverse plane which is perpendicular to the longitudinal plane. The edges 1*d* of the two vessels 1 are welded in a liquid-tight fashion as shown at a in FIGS. 1 to 3 to form an integral assembly which is totally closed except at the exhaust ports 1*c* and the open ends 1*a* which form a substantially semi-oval end opening 4 defining an inlet for admitting a mixture of fuel and air.

The vessel assembly is connected to a wall 2 defining a vessel for holding the liquid to be heated, such as oil or fat in a fryer, and defines a combustion chamber A. The wall 2 has an opening 3 which is so shaped and sized as to be able to receive the diametrically enlarged end portion of the vessel assembly. The vessel assembly is fitted in the wall opening 3 so that its end opening 4 may be located in the wall opening 3, and the end portion of the vessel assembly is fillet welded in a liquid-tight fashion to the wall 2 as shown at b and c in FIGS. 1 and 2.

Figure 6:
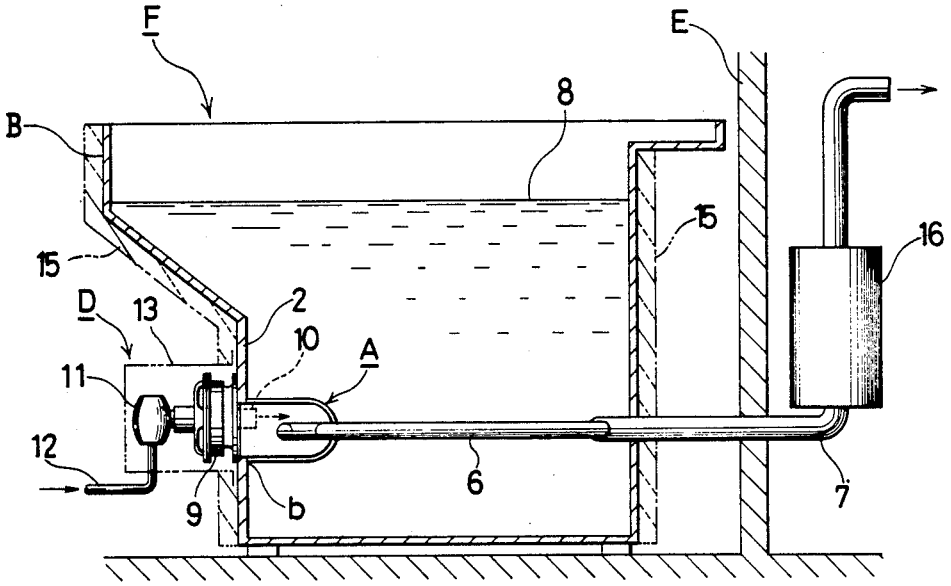
FIG. 6 is a front elevational view of an apparatus equipped with a pulsating combustor having a combustion chamber defined by the vessel assembly shown in FIGS. 1 to 3.
Figure 7:
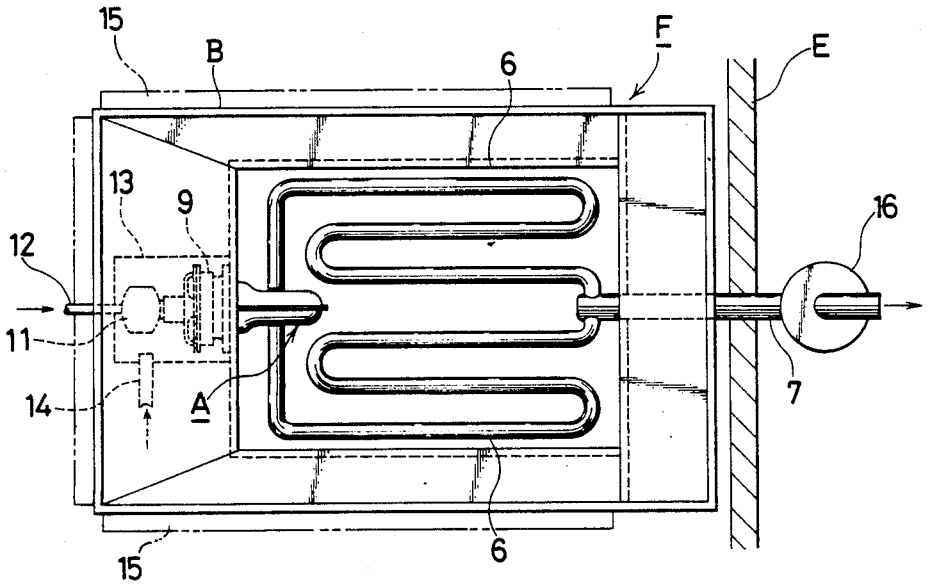
FIG. 7 is a top plan view of the apparatus shown in FIG. 6.

Attention is now directed to FIGS. 6 and 7 showing by way of example a pulsating combustor D including the combustion chamber A constructed as hereinabove described. The pulsating combustor D is used as a source of heat supply to a fryer for preparing fried food, such as what is called "tempura" in Japanese. The vessel assembly is connected to the wall 2 of the vessel B for holding frying oil or fat 8, as hereinabove described, and defines the combustion chamber A in the vessel B. Two tailpipes 6 are connected to the exhaust ports 1*c*, respectively, in a liquid-tight fashion. Each tailpipe 6 extends in a zigzag way in the vessel B and is curved to the extent that it may not create any back pressure affecting pulsating combustion in the combustion chamber A. Each tailpipe 6 is connected to an exhaust pipe 7 extending outwardly through the wall E of a building in which the fryer F is installed. The combustion chamber A and the tailpipes 6 define a heat exchanger for heating the frying oil 8 in the vessel B.

The pulsating combustor D has a mixing chamber 9 which is connected through a flame trap not shown to a combustion chamber head 10 situated in the end opening 4 tangentially to the combustion chamber A, so that a mixture of fuel and air leaving the mixing chamber 9 and flowing into the combustion chamber A may form a whirling current along the inner wall of the combustion chamber A, as shown at d in FIG. 2. Fuel gas is admitted through a gas supply pipe 12 into a gas chamber 11 in which its pressure is equalized, and is supplied into the mixing chamber 9 through a gas flapper valve not shown, but adapted to open and close automatically for each cycle of pulsating combustion, and through a gas distributor not shown, either. Air is admitted through a blower not shown and an air supply pipe 14 into an air chamber 13 in which its pressure is equalized, and is supplied into the mixing chamber 9 through an air flapper valve not shown, but adapted to open and close automatically for each cycle of pulsating combustion. The vessel B is surrounded by a vibration damping material 15 which suppresses the noise of vibration resulting from pulsating combustion and prevents any resonance from occurring in the pulsating combustor D. A decoupler 16 having an expansion chamber is provided in the exhaust pipe 7. The tailpipes 6 extend in two opposite directions from the mid-portion of the combustion chamber A at right angles to its longitudinal axis, as shown in FIG. 7.

When the pulsating combustor D is placed in operation, a mixture of fuel and air is forced into the combustion chamber A and ignited by an igniting device to burn in a pulsating way. After some period of time has passed, however, the combustor D operates in a self-aspirating and self-igniting way and repeats about 80 to 100 cycles of aspiration, explosive combustion, expansion and exhaustion per second. Exhaust gases are vented outdoors through the tailpipes 6 and the exhaust pipe 7. The heat exchanging action of the combustion chamber A and the tailpipes 6 can efficiently heat the oil or fat 8 in the vessel B.

Although the boat-shaped vessels 1 defining the combustion chamber A have been described as being welded to each other, it is also possible to join them by brazing or soldering. Although the pulsating combustor has been described as being a source of heat supply to the fryer, it is also useful as a source of heat supply to other apparatus, such as a water heater of the type in which heated water is stored.

What is claimed is:

1. A vessel assembly defining a combustion chamber in a pulsating combustor, which comprises a pair of generally convex half-shells made by plastic deformation, each of half-shells having (i) a substantially semi-oval cross section, (ii) a side opening, (iii) a rear opening which is perpendicular to the side opening, (iii) a substantially one-fourth-spheroidal front end portion, (iv) a radially enlarged rear end portion which defines the rear opening, (v) a substantially central exhaust port which is located on a side opposed to the side opening, the half-shells being joined to each other at substantially U-shaped side edges thereof defining the side openings thereof to form an integral assembly which is totally closed except for the exhaust ports and the rear openings, the rear openings of the half-shells providing together an inlet for admitting a mixture of fuel and air into the vessel assembly, and the rear end portions of the half-shells being connected to an edge of a hole made through a wall of a vessel for holding liquid to be heated, so as to connect the entire vessel assembly to the wall.

2. A vessel assembly as set forth in claim 1, wherein each of the half-shells is formed by pressing from a metal plate having a relatively small thickness into a generally convex shape.

3. A vessel assembly as set forth in claim 1, wherein the half shells are joined to each other by a method selected from among welding, brazing and soldering, while the rear end portions of the half shells are welded to the wall of the vessel.

4. A vessel assembly as set forth in claim 2, wherein the half-shells are joined to each other by a method selected from among welding, brazing and soldering, while the rear end portions of the half-shells are welded to the wall of the vessel.

* * * * *

UNITED STATES PATENT AND TRADEMARK OFFICE

CERTIFICATE OF CORRECTION

PATENT NO. : 4,895,510

DATED : January 23, 1990

INVENTOR(S) : Nobuyosi Yokoyama

It is certified that error appears in the above-identified patent and that said Letters Patent is hereby corrected as shown below:

At Column 2, line 29 delete "one-fourth-spheroidal" and insert --quarter-spheroidal--.

Signed and Sealed this

Third Day of December, 1991

*Attest:*

HARRY F. MANBECK, JR.

*Attesting Officer*

*Commissioner of Patents and Trademarks*